US005984802A

United States Patent [19]

Perrine

[11] Patent Number: 5,984,802

[45] Date of Patent: Nov. 16, 1999

[54] USER-FRIENDLY GOLF SWING PRACTICE MAT

[76] Inventor: James J. Perrine, 5330 N. Via Celeste, Tucson, Ariz. 85718

[21] Appl. No.: 09/086,930

[22] Filed: May 29, 1998

Related U.S. Application Data

[63] Continuation-in-part of application No. 08/689,241, Aug. 6, 1996, Pat. No. 5,803,826, which is a continuation of application No. 08/488,296, Jun. 7, 1995, abandoned, which is a continuation-in-part of application No. 08/430,449, Apr. 28, 1995, abandoned.

[51] Int. Cl.[6] ..... A63B 69/36

[52] U.S. Cl. ..... 473/278; 473/257

[58] Field of Search ..... 473/278, 279, 473/150, 257, 262

[56] References Cited

U.S. PATENT DOCUMENTS

| | | |
|---|---|---|
| 3,348,847 | 10/1967 | Fishcl . |
| 3,717,349 | 2/1973 | Bohnen . |
| 3,880,432 | 4/1975 | Coffey et al. . |
| 4,023,810 | 5/1977 | Lorang . |
| 4,889,342 | 12/1989 | Hugunin . |
| 4,955,611 | 9/1990 | Moller . |
| 5,028,052 | 7/1991 | Miller . |
| 5,273,285 | 12/1993 | Long . |
| 5,306,011 | 4/1994 | Perry . |
| 5,333,875 | 8/1994 | Wilson . |
| 5,354,064 | 10/1994 | Toikka . |

FOREIGN PATENT DOCUMENTS

| | | |
|---|---|---|
| 2095564 | 3/1981 | United Kingdom . |
| 551885-A1 | 1/1993 | United Kingdom . |

*Primary Examiner*—Raleigh W. Chiu

*Attorney, Agent, or Firm*—Berman & Collins

[57] ABSTRACT

A golf swing practice mat for placement on an underlying base is provided to aid a golfer in improving his or her swing of a golf club having a club head, said swing comprising a swing arc having a bottom-most portion thereof, said golf swing practice mat comprising: (a) a low friction, flexible and resilient top sheet that is directly contacted by the club head, and has a rigidity of 40 pounds per square inch or less; (b) a supporting pad for supporting the top sheet and for providing space for the top sheet to yield to and accommodate the bottom-most portion of a reasonably well-aligned swing arc, the supporting pad being compressible to 50% of its resting height in any area near its center line by an applied pressure thereupon of 0.0056 Mpa (8 psi) or less; and (c) a self-supporting, generally flat, bottom sheet around which the ends of the top sheet may be wrapped and attached thereto and which provides one or more sturdy points to which suitable fasteners may be attached to anchor the mat to the underlying base, the supporting pad supporting the top sheet a finite distance above the bottom sheet. In typical usage, the respective properties of the top sheet and the bottom pad together enable the whole mat to function so that—like a natural-grass-covered fairway—it imposes very little resistance as it readily yields to and accommodates the bottom-most portion—between the bottom of the ball and the underlying ground/base—of any full, and reasonably well aligned golf club swing arc. Golf clubs that are swung through arcs which hit down before one's stance and rotation center, and would otherwise tend to dig into a natural earth base, or a typical practice-range mat, impact relatively softly and slide forward without appreciable loss of momentum, and allow the golfer to complete the somewhat mis-aligned swing-arc without discomfort and deterrence to future efforts.

12 Claims, 5 Drawing Sheets

USER-FRIENDLY GOLF SWING PRACTICE MAT

CROSS-REFERENCE TO RELATED APPLICATIONS

The present application is a continuation-in-part of application Ser. No. 08/689,241, filed Aug. 6, 1996, now U.S. Pat. No. 5,803,826, which in turn is a continuation of application Ser. No. 08/488,296, filed Jun. 7, 1995, now abandoned, which in turn is a continuation-in-part of application Ser. No. 08/430,449, filed Apr. 28, 1995, now abandoned.

FIELD OF THE INVENTION

The present invention is directed to golf accessories, and more particularly, to practice mats used to help a golfer improve his or her swing.

BACKGROUND AND OBJECTS OF THE INVENTION

On actual golf course fairways, balls normally do not rest right on the firm ground, the so-called "turf". They are supported on a layer of soft, mowed grass extending above the ground/turf. Therefore, with practice, golfers can learn how to properly align and stabilize their body posture and swing arc, so that their club head will swing amply down to a little below the bottom of a ball, but then encounter very little additional resistance as it passes through just the grass layer between the ball and the ground/turf. Being able to swing this way is especially advantageous to the many recreational golfers of modest strength (such as many women and seniors), who can not always swing accurately and powerfully enough to overcome the frictional "drag" and compressive resistances imposed on a club head when it digs into, and takes an actual "divot" out of the ground.

All prior art golf practice mats support a golf ball be hit, but unlike real grass, do not provide for a zone of negligible friction and compression resistance between the bottom of the ball and an underlying base. All such mats, including some more recent ones designed to better simulate the particular frictional drag and compressive resistances felt when one swings a club so as to purposely take a divot out of natural ground/turf, appreciably resist any movement of a club head below the bottom of the ball, and usually two planes: (1) horizontally/forward as the club head encounters some very perceptible sliding/rubbing friction from synthetic fibers which extend from the mat's top layer, and which necessarily must be much tougher and more durable than flimsy, but self-renewing natural grass; and (2) vertically/downward as the club head compresses/flexes the top layer and/or its supporting means.

The general object of the present invention is to provide an affordable golf swing practice mat that will support a ball, but will not appreciably resist a club head's movement somewhat below the bottom of the ball in either the horizontal or vertical planes. Thus, to a golfer making a fluid, reasonably well-aligned and stabilized swing with a club, it will feel almost completely non-resistant, like swinging the club through natural, mowed, fairway grass alone, and will not require or prompt the golfer to grip the club tighter, and/or swing it more "forcibly", in order to needlessly also take a divot out of natural ground/turf.

Besides helping golfers practice and learn how to make effective, fluid, no-divot swings, such a mat will be more "user friendly", i.e. it will not jolt and punish golfers like either natural turf or prior art mats for small errors made while learning how to stabilize one's body posture and swing arc alignment and depth. For experienced golfers, it will substantially eliminate the repetitive impact shocks produced by typical range mats, that can cause tendon and joint problems.

Another object of the present invention is to provide a practice mat that will visually guide golfers as they work to master basic golf-swing techniques which promote the execution of swing-arcs that not only extend to the requisite depth, but also are tangent to the intended flight line, are favorably oriented to a ball's position relative to their stance center, and bottom out ahead of their stance center.

Yet another object of this invention is to provide a practice mat that will give helpful feedback to golfers on how well they are accomplishing the previously-described, aligned-swing-arc end-results, i.e., to show them what aspect(s) of their executed swing-arc alignment, if any, they will need to adjust through technique improvements.

Still another object of this invention is to provide a practice mat for accomplishing the preceding basic swing learning/practicing objects - both without and with an actual golf ball in place to hit, to show golfers whether and how their executed swing-arc alignment may be changing for actual ball strikes, versus preparatory practice swings.

A still further object of this invention is to provide a single golf swing practice mat that can be used with either irons or fairway woods, is simple and relatively inexpensive to manufacture, and is light and portable, so it can be used directly on various available surfaces, e.g. golf practice ranges offering either natural grass or range mats, one's own back yard—without damaging the lawn grass, or inside one's house on a carpet or floor—without damaging either.

SUMMARY OF THE INVENTION

In accordance with the present invention, a golf swing practice mat for placement on an underlying base is provided to aid a golfer in improving his or her swing of a golf club having a club head, in which the swing comprises a swing arc having a bottom-most portion thereof. The golf swing practice mat comprises:

(a) a low friction, flexible and resilient top sheet that is directly contacted by the club head, and has a rigidity of 40 pounds per square inch or less;

(b) a supporting pad for supporting the top sheet and for providing space for the top sheet to yield to and accommodate the bottom-most portion of a reasonably well-aligned swing arc, the supporting pad being compressible to 50% of its resting height in any area near its center line by an applied pressure thereupon of 0.0056 Mpa (8 psi) or less; and (c) a self-supporting, generally flat, bottom sheet around which the ends of the top sheet may be wrapped and attached thereto and which provides one or more sturdy points to which suitable means may be attached to anchor the mat to the underlying base, the supporting pad supporting the top sheet a finite distance above the bottom sheet.

In a preferred embodiment, the top sheet has a hole through it to gently retain an actual golf ball placed on the top sheet, or to allow the slightly raised center section of a golf ball sized disk to protrude through it from underneath. When contacted by a club head moving at a typical swing speed, the protruding section produces a discrete, audible sound to indicate that one's swing arc has extended sufficiently down and on line, to strike an actual ball well.

Like typical golf course fairways, the mat of the present invention imposes only a negligible amount of resistance on downward and forward club head movement during well-aligned swings. Unlike typical golf course fairways or prior art teeing mats, however, it does not inflict immediate punishments on golfers for somewhat mis-aligned swings, and is overall more user-friendly than either.

These and other objects and advantages of the invention will become apparent in the following detailed description and drawings of the invention.

DETAILED DESCRIPTION OF THE PREFERRED EMBODIMENTS

Reference is now made in detail to specific embodiments of the present invention, which illustrate the best modes presently contemplated for practicing the invention. Alternative embodiments are also briefly described as applicable.

Figure 1:
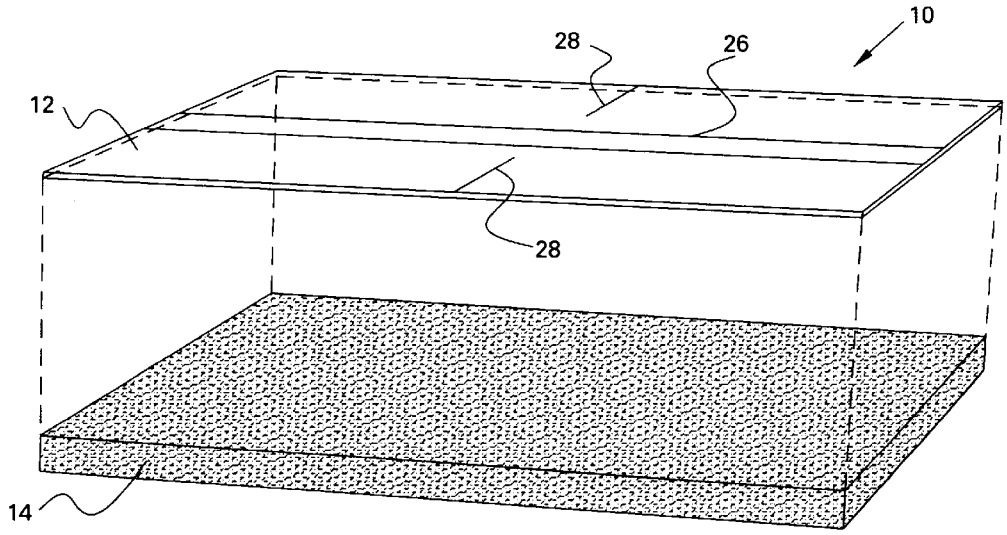
FIG. 1 is an exploded, perspective view of my golf swing practice mat invention.

FIG. 1 depicts, in exploded view, the mat 10 of the present invention. The mat 10 is comprised of just two structural elements: a top sheet 12 and a bottom pad 14.

The top sheet 12 has a completely smooth, and very low-friction surface, is resilient and tends to lie flat at rest, yet is relatively compliant/non-rigid. It is made of a suitable type, size and thickness of sheet material such as plastic. As an example, Dupont's Surlyn 8940 has a flexural modulus at 23° C. (73° F.) of 350 Mpa (51,000 psi) (ASTM D-790) according to the manufacturer, and in a 76 cm (30 inches) long, 30 cm (12 inches) wide, 0.16 cm (0.062 inch) thick sheet, gives a sheet rigidity (flexural modulus, times thickness cubed, times width, divided by 524—for S.I. units, or 12—for English units) of only about 0.082 MPa (12 psi), which works very well. A top sheet of this size and made from this material is also extremely tough and resilient, and does not develop excessive plastic (permanent) deformations under repeated blows from a golf club, even at an ambient temperature of 38° C. (100° F.), nor does it feel uncomfortably hard at 4° C. (40° F.). However, the same size sheet of Surlyn 8940, but in a 0.24 cm (0.093 in) thickness, giving a rigidity at 23° C. (73° F.) of about 0.283 MPa (41 psi), does feel a little hard and obstructive when struck with a golf club, indicating that this amount of rigidity exceeds, at least slightly, the practical upper limit for meeting the comfort and function objects of this invention. Therefore, the rigidity of the top sheet 12 of this invention is below 0.276 MPa (0 psi), and preferably below about 0.207 MPa (30 psi).

In another embodiment, the top sheet 12 is made from equally tough and resilient polyurethane, which is available in a wide range of flexural moduli from a variety of manufacturers. As an example, Goodrich's Estane 58277 has a flexural modulus of 63 MPa (9150 psi), and in a sheet the same size as the preceding Surlyn embodiments, but with a 0.254 cm (0.100 in) thickness, giving a rigidity of about 0.062 MPa (9 psi), also works well. In fact, the lower the rigidity of the top sheet 12, the closer it approaches the compliance of natural grass.

In yet another embodiment, the top sheet 12 is made of a same size sheet of Estane 58277, but in a 0.147 cm (0.058 in) thickness, giving a rigidity of only about 0.012 MPa (1.8 psi).

No doubt suitable grades, thicknesses, and sizes of other low friction materials which could also provide for sheet rigidities below 0.276 MPa (40 psi), and are tough and resilient, would also work for the top sheet 12 of this invention.

Problems of delamination, stretching, wrinkling and club head snagging that can occur with prior-art mats having an insufficiently bonded top layer of higher-friction material like "artificial turf" are avoided with the mat 10 of the present invention.

The bottom pad 14 is also resilient and very compliant. The bottom pad 14 can be the natural grass already covering the ground of a practice-range hitting area, or, to permit the top sheet 12 to be used on inadequately thick and compliant bases like typical range mats, some home carpets or floors, etc., the bottom pad can be a same size, accompanying pad having a thickness at least that of natural fairway grass, which is typically mowed to a height of 0.95 to 1.7 cm (0.375 to 0.675 in), and made from a relatively soft type of foam rubber, interwoven-fiber fabric, etc.

The amount of compressive resistance the bottom pad 14 contributes to the mat 10 is not critical so long as it does not nullify the user-friendly, sub-40 psi compliance of the top sheet 12. For example, if an embodiment of the top sheet 12 has a near-upper limit rigidity of 0.269 MPa (39 psi), then the accompanying bottom pad 14 can not add a compressive resistance greater than 0.007 MPa (1 psi). However, if the top sheet 12 has a rigidity of either 0.082 MPa (12 psi) or 0.062 MPa (9 psi), as do the preceeding first Surlyn and Estane embodiments, then the accompanying bottom pad 14 could add a compressive resistance of either 0.193 MPa (28 psi) or 0.217 Mpa (31 psi), respectively. With any preferred sub-30 psi embodiment of the top sheet 12, then a bottom pad 14 made of, for example, either a low or medium density urethane foam, which can be compressed to 50% of its resting height by an applied pressure between about 0.007 MPa (1 psi) and 0.028 MPa (4 psi), works well.

The bottom pad 14 primarily serves to support the top sheet 12, and a ball 16 (not shown in FIG. 1, but seen in FIG.

2) lying thereupon, at least a little distance above the ground or other base, so that the top sheet has room to yield easily, and allow the user's swing-arc to extend, when desired, down to a depth safely below the level of the bottom of the ball, but still above the ground/base 17.

In typical usage, the respective properties of the top sheet 12 and the bottom pad 14 together enable the whole mat 10 to function so that—like a natural-grass-covered fairway—it imposes very little resistance as it readily yields, and accommodates the bottom-most portion—between the bottom of the ball 16 and the underlying ground/base 17—of any full, and reasonably well-aligned golf club swing-arc 18. And, golf clubs that are swung through arcs which hit down before one's stance and rotation center, and would otherwise tend to dig into a natural earth base, or a typical practice-range mat, impact relatively softly and slide forward without appreciable loss of momentum, and allow the golfer to complete the somewhat mis-aligned swing-arc without discomfort, and deterrence to future efforts.

Figure 2:
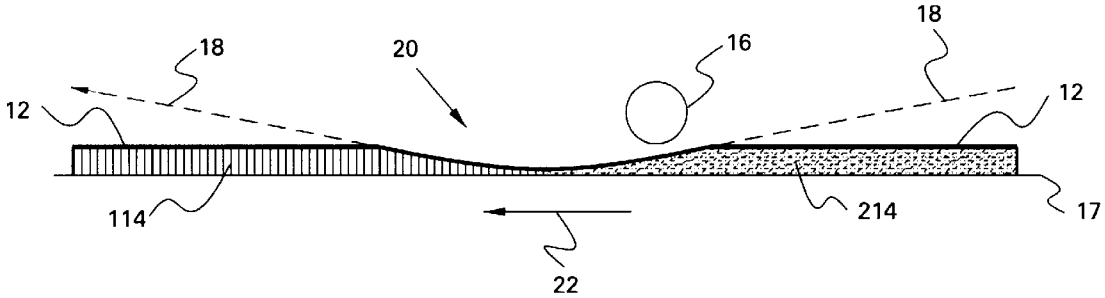
FIG. 2 is a side view of the mat of FIG. 1 as it accommodates a good golf club swing-arc.

FIG. 2 depicts the top sheet 12 resting either on natural grass 114 or on an accompanying bottom pad 214. The top sheet 12 is seen to deform in the region 20 as it accommodates a good golf club swing arc 18 executed to hit a golf ball 16 in the position indicated. The direction of travel of the golf club head (not shown) is indicated by arrow 22.

Figure 3:
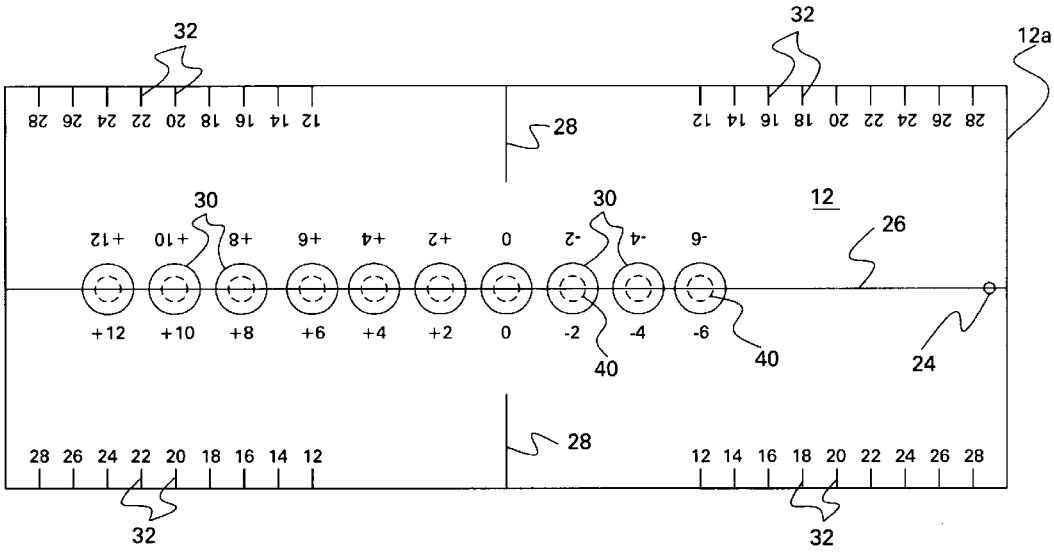
FIG. 3 is a top, plan view of a first embodiment of my invention, showing the markings visible on the mat of FIG. 1.

Turning now to FIG. 3, a hole 24 in the top sheet 12 centered near its back edge 12*a* will accommodate a nail or equivalent to be placed through it into natural earth, to anchor the mat when it is used on natural grass-covered-earth practice areas.

The accompanying bottom pad 14 has relatively high-friction surfaces, which serve to anchor the mat when it is used on top of range mats, home carpets or floors, etc.

A screw (not shown) placed through the back hole 24 in the top sheet 12, and through a corresponding hole in the accompanying pad 14, and held in place by a wing nut (not shown), prevents slippage between the two. The top sheet 12 and accompanying bottom pad 14 also can be thermally or adhesively bonded to produce a somewhat more expensive version of the mat 10, which, however, is more convenient.

Figure 4:
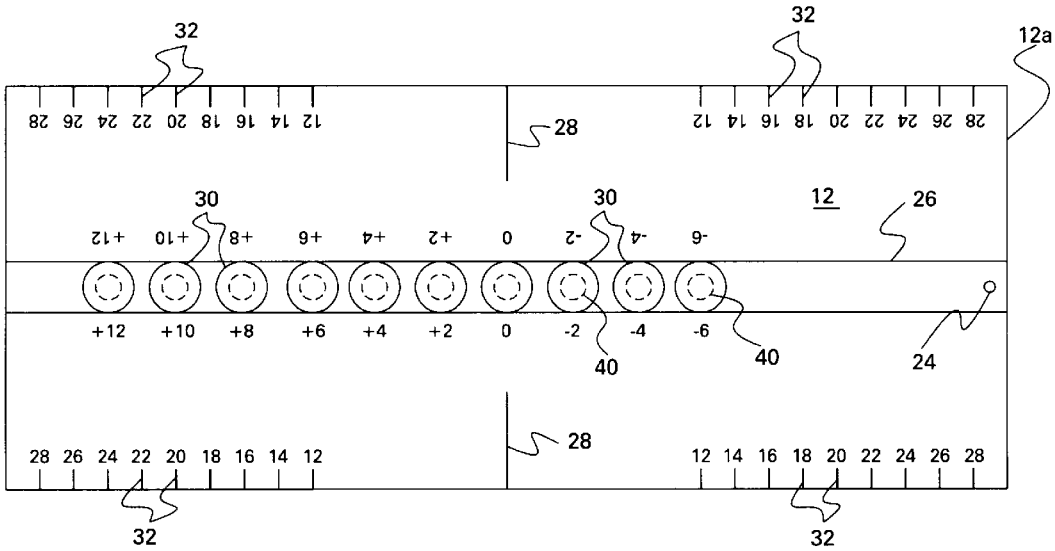
FIG. 4 is a top, plan view of a second embodiment of the markings visible on the mat of FIG. 1.

Markings and guidelines are placed on the top sheet 12 to help users achieve proper body and swing-arc alignments. The markings include meaningful representations and indicators (such as those shown in FIGS. 3 and 4) of any or all of the following: the intended flight line/track 26 of a ball, the proper placement—front to back in the horizontal plane—of the user's stance center at address 28, specific ball positions 30—also front to back in the horizontal plane, and specific, incremental stance widths 32.

The top sheet 12 may be made from a semi- to fully-transparent type of plastic so that the preceding markings and guidelines, etc. placed on its underside, or some other surface underneath the top sheet, will show through to the user, but not be rubbed off from repeated contacts by a golf club.

The preceding markings and guidelines are placed bilaterally on or under the top sheet 12, so that golfers with either right or left-handed swings can be guided by them when they use the mat 10.

Figure 5:
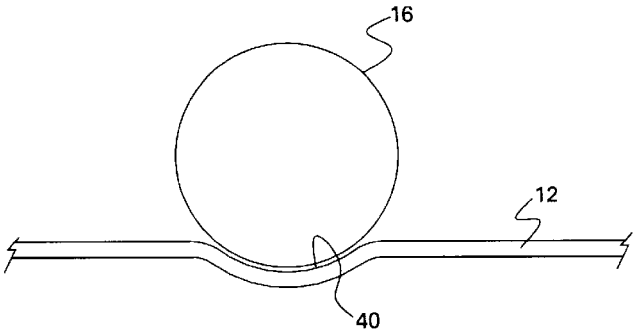
FIG. 5 is a side elevational view, in detail, of one of the shallow dimples formed in the mat of FIG. 1, with a golf ball resting therein.

As shown in FIG. 5, shallow dimples 40, pressure- or thermo-formed in the top sheet 12, facilitate the placing of a golf ball 16 at one or more locations on the top sheet 12, e.g., at the center of each of the indicated ball positions 30.

Any one of the indicated ball positions 30 on the mat 10 can be observed by itself, without an actual ball in place to hit, for very useful, basic, aligned-swing-arc practice.

Unlike natural grass or artificial-turf-covered teeing mats, the top sheet 12 of mat 10 of the present invention provides a gentle, but distinct, audible and tactile feedback to users as to whether, and to some degree by how much their swing-arcs 18 have extended down to somewhat below the level of the top sheet, and thus the bottom of a ball. However unlike the No. 10, "turfless" teeing mat described in U.S. Pat. No. 5,273,285, issued to Long, which specifies using a considerably more rigid combination of size, thickness and material type for its top sheet, e.g., a 81 cm (32 inches) long, 17 cm (6.75 inches) wide, 0.20 cm (0.080 inch) thick sheet of polycarbonate, which has a 2379 MPa (345,000 psi) flexural modulus, and gives a sheet rigidity of about 0.689 MPa (100 psi), vs the rigidity of about 0.082 MPa (12 psi) for the even wider sheet of Surlyn 8940 preferred for the present invention, no sharp and unpleasant impact shocks are produced by the top sheet the present invention. A mat whose top sheet rigidity exceeds 0.276 MPa (40 psi), regardless of the softness of a cushion underneath, would surely incline many users to either grip too tightly, or to tend to steer their club head so that it does not smack against the hard top surface of the mat, and thus not extend down fully to, or a little below the bottom of the ball, as is desirable.

The combination of the smoothness, impermeability, resting flatness, and compliance of the top sheet 12 employed in the present invention also permits a visible substance like a common, household spray-wax, or foamy soap solution, to be applied to it—to temporarily register the actual path of a golf club's head passing through the hitting area, when the club head is in contact with the top sheet near (both somewhat before and beyond) the bottom point of a given, practice swing-arc 18.

The smoothness of the top sheet 12 also permits a golfer or an instructor to place additional, temporary markings on it, with an ordinary, erasable marking pen, to further guide the golfer. For example, the approximate, normal amount of sideways curvature in the swing-arc of a given golf club—in relation to the straight flight line/track 26 of a ball—may be drawn on the mat 10 for learning purposes.

Figure 6:
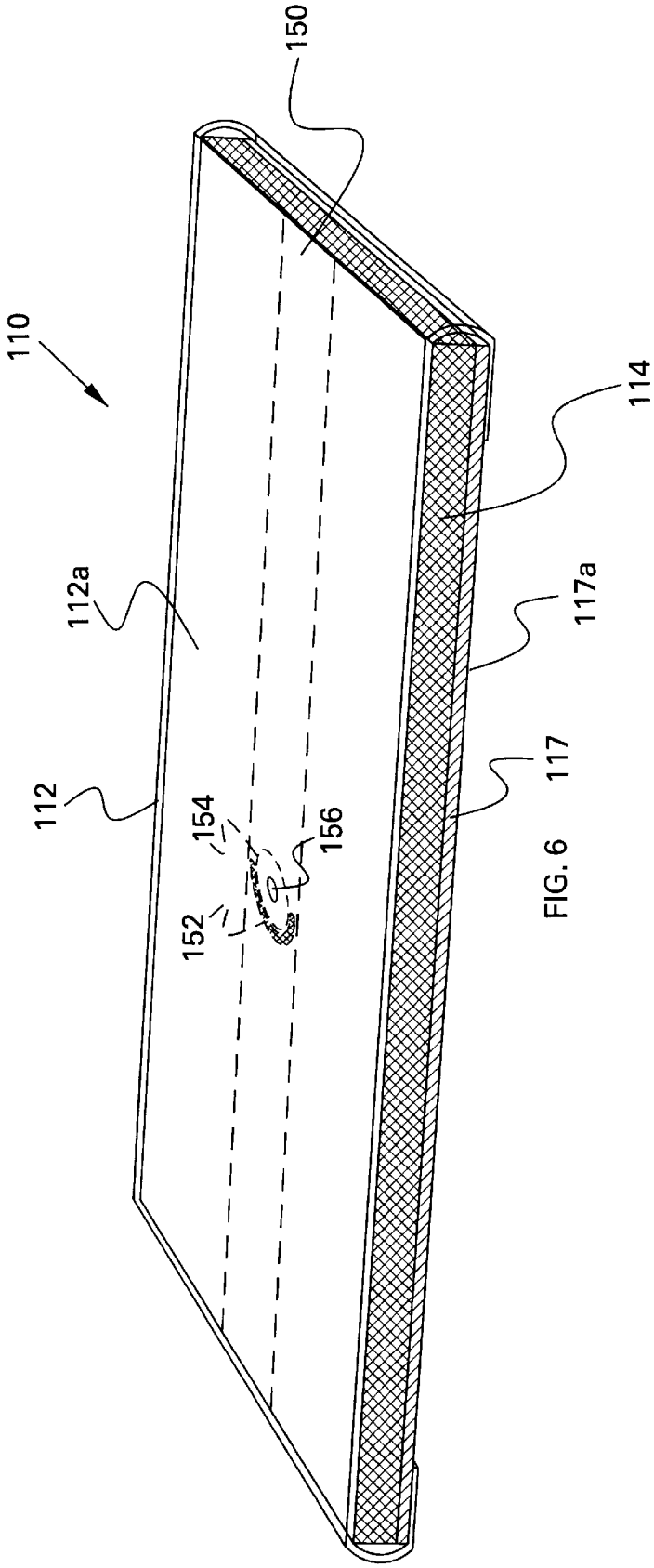
FIG. 6 is a perspective view of another embodiment of my golf mat invention.

FIG. 6 depicts another embodiment of the present invention which a golf swing practice mat 110 comprises three main elements: an uppermost top sheet 112, a supporting pad 114, and a bottom sheet 117.

The top sheet 112 is made from one of the smooth, low-friction, tough, flexible types of plastic material used for the preceding embodiments, but, because it can now be wrapped around, and fastened to the added bottom sheet 117, it can be a thinner gauge, and thus even more compliant. For example, the top sheet 112 can be made from a 30 cm (12 in) wide, 0.051 cm (0.020 in) thick sheet of Estane 58277, having a rigidity of only about 0.0005 MPa (0.07 psi).

A strip 150 of the same or chemically compatible, plastic material, with a similar thickness and length, and a width on the order of 6.5 cm (2.5 in), may be thermally or adhesively bonded to the under surface of the top sheet 112, running longitudinally along its center. If the top sheet 112 is at least semi-transparent, and the underlying strip 150 is appreciably less transparent, and/or of an appreciably different color, it will be visible to a user, and provide him/her with a distinct indication of a ball's intended flight line/track.

Figure 7:
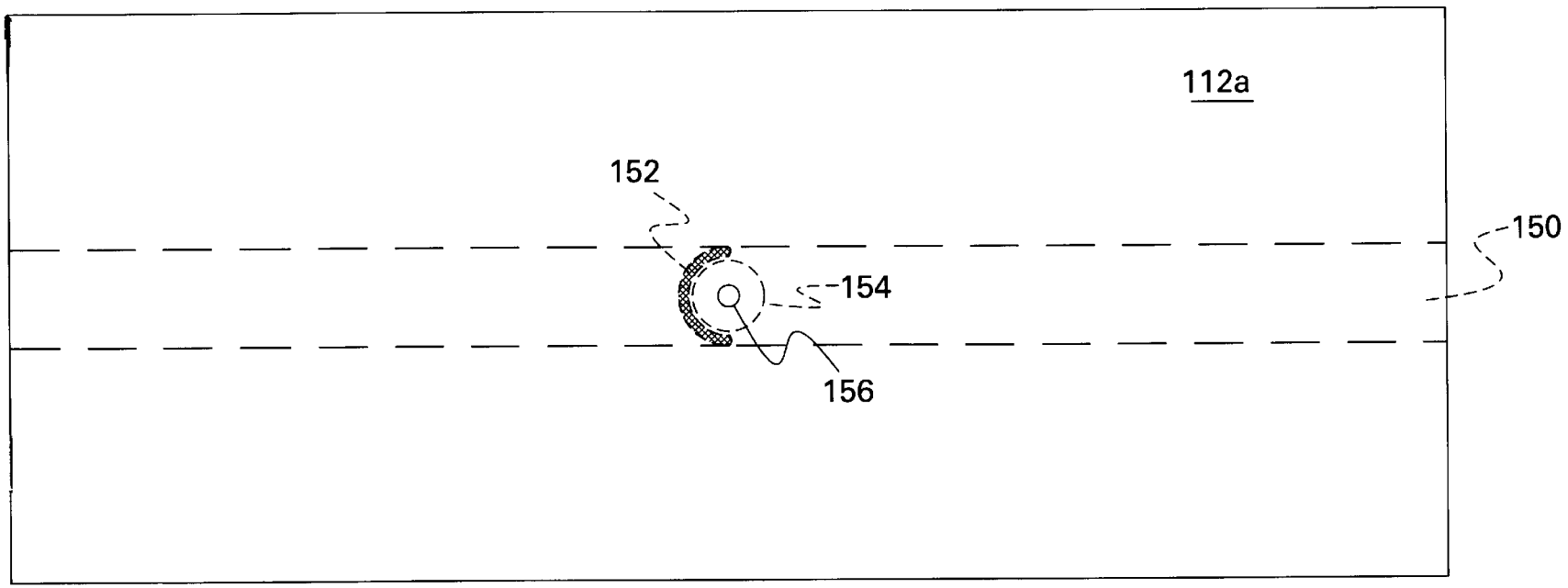
FIG. 7 is a top, plan view of the mat, showing the location of a hole in the top sheet of the mat, a strip underlying the top sheet, a forward oriented, semi-circular bonding area between the two (the top sheet and the underlying strip), and a removable, golf ball-sized disk which may be inserted in a pocket formed behind the bonding area, between the top sheet and the underlying strip.

If, as is shown in detail in FIG. 7, the underlying strw 150 is bonded to the top sheet near the center of each, and a bonded area 152 is effectively in the form of a forward oriented semi-circle, with an inner radius on the order of 2.1 cm (0.84 in), it will leave a "pocket" into which a removable round disk 154 of plastic material of approximately the same diameter, e.g. 4.2 cm (1.68 in) and color, e.g. white, of a standard golf ball, may be placed. Such a disk 154 will indicate the position of a golf ball to be hit when practicing properly stabilized and aligned golf club swings, but without hitting an actual golf ball.

As shown also in FIG. 7, a hole 156 on the order of 1.56 cm (0.625 in) in diameter may be provided near the center of the top sheet 112 only. This hole 156 permits an actual golf ball to be placed on and hit from the mat 110. The ball will rest slightly down in, and be gently retained by the hole 156. The underlying strip 150 prevents material from the supporting pad 117, or the ground 117' (seen in FIG. 9*a*), from protruding through the hole 156, and possibly soiling and degrading the smooth, slick top surface 112*a* of the top sheet 112.

Figure 8C:
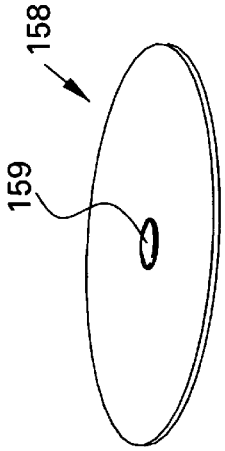
FIG. 8*c* is a perspective view of the golf ball sized disk of FIG. 8*a;*
Figure 8A:
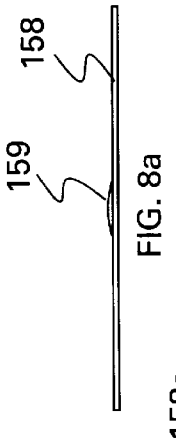
FIG. 8*a* is a side view of a golf ball sized disk with a slightly raised center section.
Figure 8B:
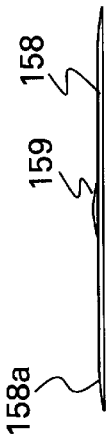
FIG. 8*b* is a view similar to that of FIG. 8*a,* but depicting a tapered top surface of the disk.

The hole 156 in the top sheet 112 also permits a removable disk 158 with a slightly raised, and relatively rigid center section 159, an example of which is shown in FIGS. 8*a*–8*c*, to be used during "ball-less" practice to both indicate an actual ball's position, and to confirm that a user's swing arc has extended sufficiently down and on line to hit an actual ball well. The center section 159, which is somewhat smaller than the hole 156, protrudes through the hole, and above the top sheet 112. The disk 158 can be molded with the raised center section 159, or the raised center section can be thermo-formed in the disk in a separate step in its production.

When a user executes a swing with a well-aligned swing arc, the head of the golf club will contact this protruding, center section 159 of the disk 158, and make a distinct, audible "click". Because the rest of the top sheet 112 of this embodiment of my invention is so soft, slick, and quiet, this sharp "click" provides a user with a discrete form of position- and depth-specific feedback during a practice swing that is very similar to that received from hitting an actual golf ball well. Moreover, consequential differences in swing arc alignment or depth from swing to swing can be heard. Stiffer, and/or "artificial-turf" covered practice mats of the prior art that produce a non-discrete impact or brushing sound no matter how or where a club head contacts them cannot provide for this type of precise swing practice and feedback, absent hitting an actual ball. Such feedback is a critical element human neuromuscular learning processes.

Like an actual golf ball, even the slightly protruding center section 159 of such a disk 158 will absorb tremendous energy when contacted by a fast moving golf club head during a fluid swing, and after many swings, usually several hundred, it will deteriorate. Fortunately it is a simple matter to replace the removable and inexpensive plastic disk 158 with another one.

The disk 158, but for the center section 159, may have a substantially constant thickness, as shown in FIG. 8*a*. Alternatively, the disk 158 may have a tapered top surface 158*a* to give it a thinner edge, as shown in FIG. 8*b*. As with the raised center section 159, the disk 158 can be molded with the tapered top surface 158*a*. Alternatively, the tapered top surface 158*a* may be machined or thermo-formed in a separate step in the production of the disk 158.

The top sheet 112 is long enough to both leave enough room for an intervening supporting pad 114 of ample thickness, and to wrap around underneath the ends of the bottom sheet 117, and be fastened to it with thin headed push pins, rivets, or the like. The bottom sheet 117 is sufficiently rigid to be self-supporting, and remain flat, even when lying on an uneven surface 117'. Unlike the high-friction undersurface of the bottom supporting pad 17 of the preceding embodiment, the bottom sheet 117 of this embodiment has a substantially smooth, low-friction undersurface 117*a*. When anchored from a single, center point (not shown), near the rear edge of the bottom sheet 117, the mat can slide pivotally around that point, over a carpet, range mat, etc. During ball-less swing practice, any such pivotal sliding will indicate to a user that although one's club head contacted the mat 110 during the last swing, the swing arc was aligned so that an actual ball would likely have been hit on a line other than the intended flight line. The mat 110 can be anchored in this manner, to an underlying base 117', by placing a suitable drapery hook, stud, spike, etc., through a center hole (again, not shown, but similar in placement to the hole 24 in the top sheet 12 shown in FIGS. 3 and 4) near the rear edge of the bottom sheet 117, and then into the underlying base material.

Figure 9A:
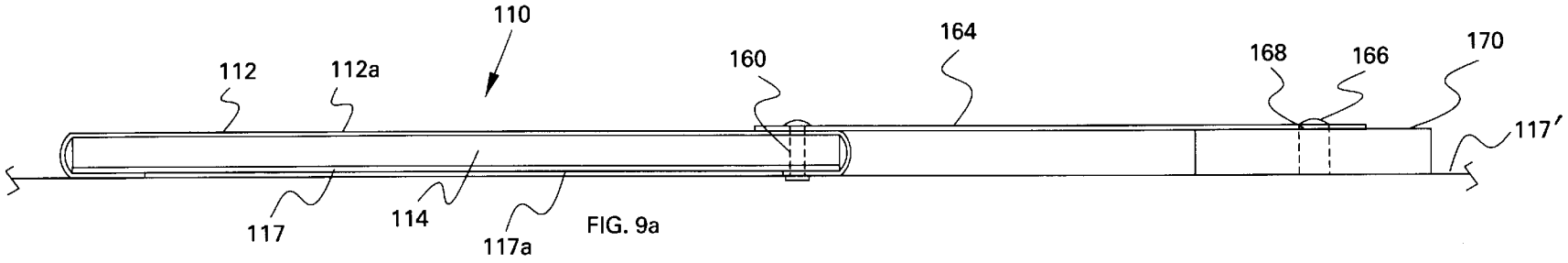
FIG. 9*a* is a side view of yet another embodiment of my golf mat invention, with an extension sheet attached over the top rear portion of the mat.
Figure 9B:
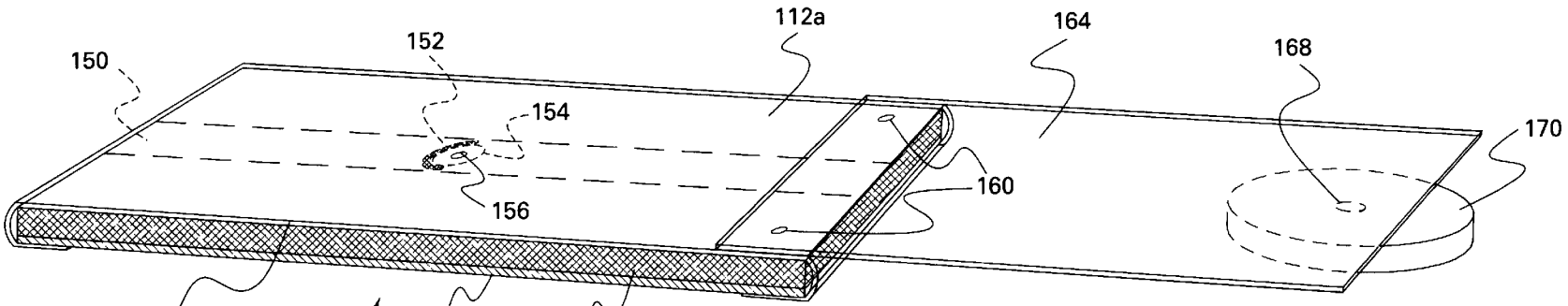
FIG. 9*b* is a perspective view of the embodiment depicted in FIG. 9*a*.

To enable the mat 110 to be transported easily, including inside most full-size suitcases, its overall length can be on the order of just 60 cm (24 in). However, to protect a mat of this length from being hit on its rear edge by a particularly errant swing, a removable extension sheet 164 can be attached with suitable fasteners, such as screws and nuts or equivalent, over the top rear portion of the mat 110. The extension sheet 164 is made of a resilient, semi-rigid material which will absorb the blow of a very mis-aligned swing, and deflect it over the top of the rear edge of the mat 110. The mat 110 may be pivotably anchored by a hook, etc. (not shown) through a hole 168 near the rear edge of the extension sheet 164. Alternatively, the extension sheet 164 may be pivotably anchored by a stud 166 which passes through the hole 168 and is inserted into the center hole of a disk weight 170 or equivalent, to allow the mat 110 to be anchored without hooks, or used on impenetrable surfaces such as concrete. FIGS. 9*a* and 9*b* show such an arrangement.

The supporting pad 114 is made of a relatively soft foam or inter-woven fibers as in the preceding embodiment. However, in the instant embodiment, because the top sheet 110 can be so thin and flexible, the supporting pad 114 can be somewhat firmer, and still meet the objects of the invention. For example, a supporting pad 114 that is compressible to 50% of its resting height in any area near its center line, by an applied pressure of as much as 0.0056 MPa (8 psi), could be used, if desired. Also, in this embodiment, it is easy to substitute pads of somewhat different compliances or heights for different effects and applications, or to replace ones that become worn out. The different pads 114 simply slip in and out from the sides of the mat 110.

I believe that my golf swing practice mat 10 and 110 provides a number of novel benefits to a practicing golfer, including:

(a) the combination of a relatively low amount of friction and a high degree of compliance that is provided by the mat, which enables it to accommodate well-aligned swing-arcs as readily as typical golf course fairways, and also accept somewhat mis-aligned swing-arcs without imposing immediate motion or comfort penalties;

(b) the particular visual guidelines for body and swing-arc alignment that are provided by the mat; and (c) the feedback provided on how well one's swing-arc has met the various alignment criteria during a practice swing—including the audible and tactile indications, the visible track left in an applied substance as the mat yields to the golf club near the bottom of its particular swing-arc, and, in the mat 110, the degree of pivotal movement of the mat around its rear anchor point upon being contacted by a club during a mis-aligned swing.

Thus, there has been disclosed a more user-friendly golf swing practice mat. It will be readily apparent to those skilled in this art that various changes and modifications of an obvious nature may be made, and all such changes and modifications are considered to fall within the scope of the invention, as defined by the appended claims.

What is claimed is:

1. A golf swing practice mat for placement on an underlying base to aid a golfer in improving his or her swing of a golf club having a club head, said swing comprising a swing arc having a bottom-most portion thereof, said golf swing practice mat comprising:

(a) a low friction, flexible and resilient top sheet that is directly contacted by said club head, and has a rigidity of 40 pounds per square inch or less;

(b) a supporting pad for supporting said top sheet and for providing space for said top sheet to yield to and accommodate said bottom-most portion of a reasonably well-aligned swing arc, said supporting pad being compressible to 50% of its resting height in any area near its center line by an applied pressure thereupon of 0.0056 Mpa (8 psi) or less; and (c) a self-supporting, generally flat, bottom sheet around which the ends of said top sheet may be wrapped and attached thereto, and which provides one or more sturdy points to which suitable means may be attached to anchor said mat to said underlying base, said supporting pad supporting said top sheet a finite distance above said bottom sheet.

2. The golf swing practice mat of claim 1, wherein said top sheet has an underside, which is contacted by said supporting pad, and wherein a piece of material substantially similar to that of said material of said top sheet is bonded to said underside of said top sheet.

3. The golf swing practice mat of claim 2, wherein said piece of material is bonded to said top sheet in such a way as to leave a pocket into which a round, golf ball-sized disk of material may be inserted.

4. The golf swing practice mat of claim 3, wherein said round disk contains a raised center section which protrudes through a hole in said top sheet after being inserted into said pocket.

5. The golf swing practice mat of claim 1, wherein said bottom sheet has a forward portion and a rearward portion, aligned in the same direction as said swing arc, and means associated with its rearward portion to prevent said mat from moving in a forward direction over said underlying base, but to allow said mat to slide pivotally if contacted by a club head during a mis-aligned swing.

6. The golf swing practice mat of claim 1, wherein said mat has a forward portion and a rearward portion, aligned in the same direction as said swing arc, and wherein a removable, resilient, semi-rigid extension sheet is attached over the rear portion of said mat.

7. The golf swing practice mat of claim 6 further including means for retaining said mat from moving in a forward direction, said means associated with said extension sheet.

8. The golf swing practice mat of claim 1, wherein said bottom sheet has a low friction bottom surface, which rests directly on said underlying base, and also has a forward portion and a rearward portion, aligned in the same direction as said swing arc, and means associated with its rearward portion to prevent said mat from moving in a forward direction over said underlying base, but to allow said mat to slide pivotally if contacted by a club head during a mis-aligned swing.

9. The golf swing practice mat of claim 8, wherein said mat has a forward portion and a rearward portion, aligned in the same direction as said swing arc, and wherein a resilient, semi-rigid extension sheet is attached over the rear portion of said mat.

10. The golf swing practice mat of claim 9 further including means associated with said extension sheet to prevent said mat from moving in a forward direction over said underlying base, but to allow said mat to slide pivotably if contacted by a club head during a mis-aligned swing.

11. A golf swing practice mat for placement on an underlying base to aid a golfer in improving his or her swing of a golf club having a club head, said swing having a swing arc, and said golf swing practice mat having a rearward portion and a forward portion, aligned in the same direction as said swing arc, said golf swing practice mat comprising:

(a) a top surface which is directly contacted by said club head during a practice swing;

(b) a low friction bottom surface which rests directly upon said uderlying base; and (c) means associated with said rearward portion to prevent said golf swing practice mat from moving in a forward direction over said underlying base, but to allow said golf swing practice mat to slide pivotally if it is contacted by a club during a mis-aligned swing.

12. A golf swing practice mat for placement on an underlying base to aid a golfer in improving his or her swing of a golf club having a club head, said swing having a swing arc, said golf swing practice mat comprising:

(a) a first section, having a rearward portion and a forward portion, aligned in the same direction as said swing arc, and having a top surface which is directly contacted by said golf head during a practice swing, and a low friction bottom surface which rests directly on said underlying base; and (b) a second, separate section, which includes means to substantially anchor said first section to said underlying base, and to which the rearward portion of said first section is coupled to prevent said first section from moving in a forward direction over said underlying base, but to allow said first section to slide pivotally if its top surface is contacted by a club head during a mis-aligned swing.

* * * * *

UNITED STATES PATENT AND TRADEMARK OFFICE

CERTIFICATE OF CORRECTION

PATENT NO. : 5,984,802
DATED : November 16, 1999
INVENTOR(S) : James J. Perrine

It is certified that error appears in the above-identified patent and that said Letters Patent is hereby corrected as shown below:

Title page,
Item [63], delete "08/488,296, Jun. 7, 1996, abandoned, which is a continuation-in-part of application No. 08/430,449, Apr. 28, 1995, abandoned" and insert -- 08/448,296, Feb. 28, 1995, abandoned --.

Column 1,
Lines 10 thru 12, delete "08/488,296, filed Jun. 7, 1995, now abandoned, which in turn is a continuation-in-part of application Ser. No. 08/430,449, filed Apr. 28, 1995, now abandoned." and insert -- 08/448,296, Feb. 28, 1995, abandoned --.

Signed and Sealed this

Eighteenth Day of March, 2003

JAMES E. ROGAN
*Director of the United States Patent and Trademark Office*